US005161704A

United States Patent [19]

Valiulis

[11] Patent Number: 5,161,704

[45] Date of Patent: Nov. 10, 1992

[54] SHELF DIVIDER

[75] Inventor: Stanley C. Valiulis, Rockford, Ill.

[73] Assignee: Southern Imperial, Inc., Rockford, Ill.

[21] Appl. No.: 801,002

[22] Filed: Dec. 2, 1991

[51] Int. Cl.[5] ..... A47F 5/00

[52] U.S. Cl. ..... 211/184; 108/61; 248/225.1

[58] Field of Search ..... 211/184, 43; 108/60, 108/61; 248/225.1

[56] References Cited

U.S. PATENT DOCUMENTS

| | | | |
|---|---|---|---|
| 1,450,191 | 4/1923 | Sturm | 108/61 |
| 2,626,063 | 1/1953 | Echlin | 211/43 X |
| 3,285,429 | 11/1966 | Propst | 211/184 |
| 3,301,408 | 1/1967 | Craine | 211/184 |
| 3,559,815 | 2/1971 | Huddleston | 211/184 |
| 3,780,876 | 12/1973 | Elkins | 211/184 |
| 3,921,811 | 11/1975 | Dameron | 211/184 X |
| 4,712,694 | 12/1987 | Breslow | 211/184 |

*Primary Examiner*—Robert W. Gibson, Jr.
*Attorney, Agent, or Firm*—Leydig, Voit & Mayer

[57] ABSTRACT

A divider for separating a retail display shelf into specific zones and maintaining merchandise in an orderly and segregated arrangement while preventing the mingling of different merchandise. The divider includes an upright dividing panel made of plastic and formed with a laterally extending foot for helping support the panel in an upright position on the shelf. A plate with resilient tabs is formed integrally with the foot, extends downwardly from the front of the dividing panel, and is adapted to be snapped into a channel at the front of the shelf. The divider may be shifted to infinitely adjusted positions along the shelf by sliding the plate in the channel.

7 Claims, 1 Drawing Sheet

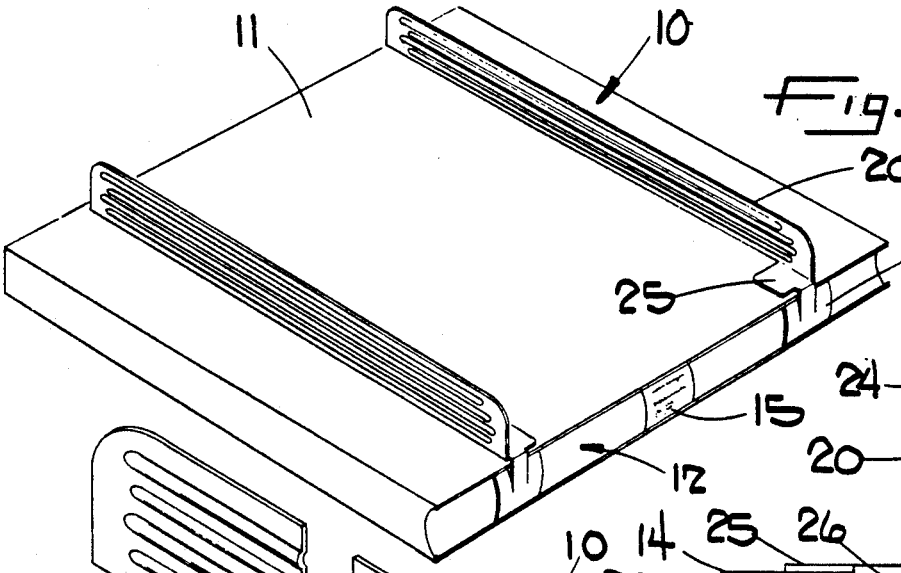
Fig. 1.
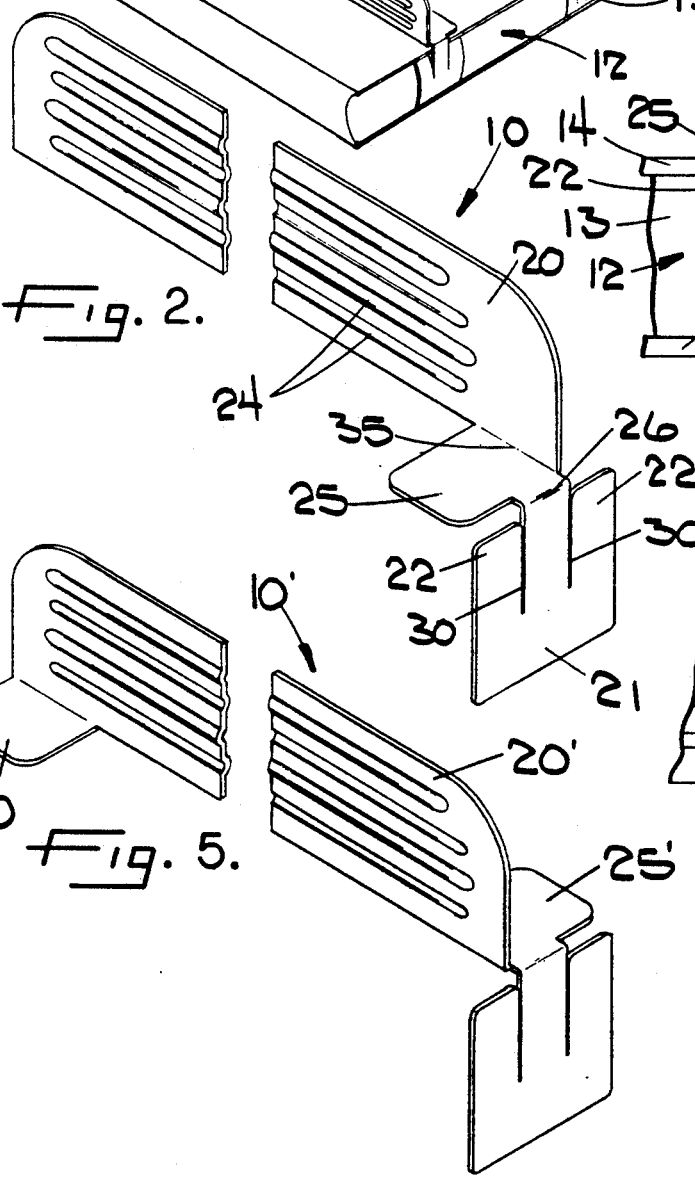
Fig. 2.
Fig. 5.
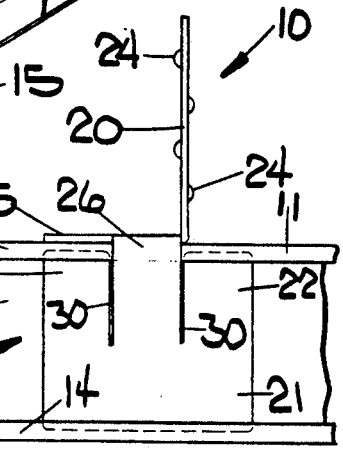
Fig. 3.
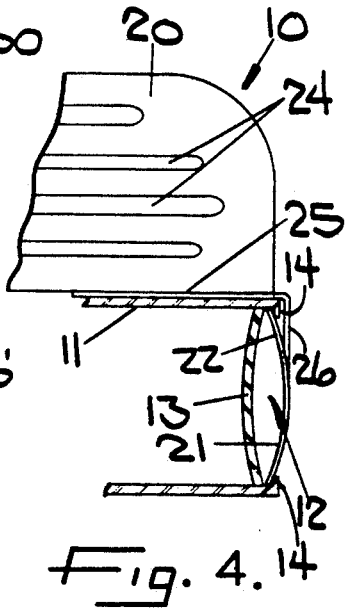
Fig. 4.

SHELF DIVIDER

FIELD OF THE INVENTION

This invention generally relates to a divider for use on a retail display shelf and, more particularly, to a zoning divider for attachment to the front edge of the display shelf.

BACKGROUND OF THE INVENTION

Dividers are used on retail display shelves to separate a shelf into zones and help maintain merchandise within a specific zone in an orderly arrangement. Shelves with a horizontal channel along their front facing edge have been widely used. The channel is designed to accommodate snap-in type inserts which contain pricing or inventory information. Such inserts can be readily placed in the channel, adjusted horizontally along the channel, or removed from the channel.

SUMMARY AND OBJECTIVES OF THE INVENTION

The primary aim of the invention is to provide a relatively simple and inexpensive shelf divider which may be quickly and easily attached to, adjusted along, and removed from a retail display shelf and which is adapted to snap into a longitudinal channel along the front edge of the shelf. Upon attachment to the shelf, the divider separates the areas of the shelf into specific zones for confining and maintaining particular merchandise in an orderly manner while preventing the merchandise from mingling with different merchandise.

A more detailed object of the invention is to achieve the foregoing by providing a shelf divider having a front plate with tabs which snap into the longitudinal channel along the front edge of the shelf. By snapping the front plate into the longitudinal channel, the divider may be securely attached to the shelf at any desired point along the shelf and easily removed or repositioned as necessary. A dividing panel extends from the front plate of the divider to the rear of the shelf. The dividing panel may be stabilized by a foot which rests on the shelf at the front and/or rear of the panel.

Another object of the invention is to provide a zoning divider which may be easily and inexpensively manufactured by stamping the divider out of a sheet of plastic.

These and other objects and advantages of the invention will become more apparent from the following detailed description when taken in conjunction with the accompanying drawings.

BRIEF DESCRIPTION OF THE DRAWINGS

FIG. 1 is a perspective view of a shelf having a longitudinal channel along its front edge and equipped with new and improved shelf dividers incorporating the unique features of the present invention.

FIG. 2 is an enlarged perspective view of one of the dividers shown in FIG. 1.

FIG. 3 is a front view of the divider illustrated in FIG. 1 and shows the plate of the divider snapped into the longitudinal channel of the shelf.

FIG. 4 is an side view of the divider and shelf illustrated in FIG. 3, certain parts being broken away and shown in section.

FIG. 5 is a view similar to FIG. 2 but shows a modified divider having a stabilizing foot at the rear of the divider as well as at the front of the divider.

DETAILED DESCRIPTION OF THE PREFERRED EMBODIMENTS

As shown in FIG. 1, the invention is embodied in a divider generally designated as 10 and used to divide a retail display shelf 11 into separate zones. Several dividers may be used on one shelf and serve to keep merchandise in separate and specific zones in a neat and orderly manner.

Herein, the shelf 11 is formed with a longitudinal channel 12 along its front edge. The channel is defined by a curved back member 13 and by upper and lower flanges 14 spaced forwardly from the back member and located adjacent the upper and lower ends of the back member. The channel conventionally is used to hold a flexible snap-in price tag such as the tag 15 shown in FIG. 1.

In accordance with the present invention, the divider 10 includes an upright divider panel 20 made of plastic and further includes an integral front plate 21 having tabs 22 which may be snapped into the shelf channel 12 in order to retain the divider in place on the shelf 11. The snap-in tabs enable quick and easy installation of the divider and enable the divider to be adjusted infinitely along the shelf to any desired position.

More specifically, the divider panel 20 is a relatively thin and flexible member disposed in a vertical plane and extending from front-to-rear along the shelf 11. Several horizontally extending and vertically spaced parallel ribs 24 are formed in the panel to stiffen the panel and restrict vertical bowing thereof. Advantageously, a laterally projecting foot 25 is formed integrally with the forward end portion of the panel 20 and projects horizontally from one side of the panel. The foot rests on the upper side of the shelf 11 and helps support the panel in an upright position on the shelf.

The plate 21 is integral with the foot 25 and is located in front of and below the panel 20 in a vertical plane extending perpendicular to the plane of the panel. The plate and the foot are integrally joined by an inverted L-shaped connector 26 having a horizontal portion extending forwardly from the foot and having a vertical portion which extends downwardly in front of the shelf 11.

To form the tabs 22, two vertically extending slits 30 are cut through the plate 21 on opposite sides of the connector 26, the slits starting at the upper edge of the plate and terminating a substantial distance above the lower edge of the plate. As a result of the slits, the two tabs may be bowed rearwardly out of the vertical plane normally occupied by the plate and by the vertical portion of the connector.

When the plate 21 is in a relaxed position, the vertical distance between the upper and lower edges of the plate is somewhat greater than the vertical dimension of the shelf channel 12. To insert the plate into the channel, the plate and the tabs 22 are bowed beyond the position shown in FIG. 4 to enable the upper edges of the tabs and the lower edge of the plate to clear the flanges 14. The plate and the tabs then are slipped into the channel and, upon being released, tend to snap back to their original positions but become trapped in a bowed position between the back member 13 and the flanges 14 of the channel as illustrated in FIG. 4. The resiliency of the material presses the plate 21 and the tabs 22 frictionally against the flanges 14 to help support the divider 10 in an upright position and to releasably hold the divider against sliding lengthwise in the channel 12. By pushing laterally on the divider, however, the frictional force may be overcome to enable the divider to be adjusted to any desired position along the shelf 11.

The divider 10 may be formed by blanking the entire unit out of a flat piece of plastic. Thereafter, the foot 25 is folded at right angles to the panel 20 along a line 35 (FIG. 2) while the vertical portion of the connector 26 is folded at right angles relative to the horizontal portion thereof at the corner of the L. Thus, the divider may be manufactured at relatively low cost.

In some cases, it may be advantageous to secure a pad with pressure-sensitive adhesive to the lower side of the foot 25, the adhesive helping hold the foot against slippage on the shelf 11. If the height of the channel 12 is greater than the height of the plate 21, a pad with pressure-sensitive adhesive may be secured to the rear side of the plate so that the adhesive will stick to the back member of the channel and hold the plate in place.

A modified divider 10' is shown in FIG. 5 and is the same as the divider 10 of FIGS. 2 to 4 except that the divider 10' includes a rear foot 40 which projects from the panel 20' in a direction opposite from the front foot 25'. The rear foot lends additional stability to the divider. Also, the divider 10' is of opposite "hand" from the divider 10 in that the front feet 25, 25' of the two dividers project in opposite directions from the panels 20, 20' thereof. It should be understood, however, that all dividers may be of the same hand and that it is not essential to provide both left and right-hand dividers.

I claim:

1. A shelf divider made from a single piece of resiliently flexible plastic, said divider having an elongated dividing panel disposed in an upright plane, said panel having upper and lower edges and forward and rear ends, a stabilizing foot integral with and projecting horizontally from the lower edge of said panel, a generally flat plate extending downwardly from said panel adjacent the forward end thereof and joined integrally to said panel, said plate being disposed in an upright plane located substantially perpendicular to the plane of said panel, said plate having integral tab means normally disposed in the plane of said plate and capable of being flexed rearwardly from the plane of said plate.

2. A shelf divider as defined in claim 1 in which said plate includes upper and lower edges, a connector integral with and extending upwardly from the upper edge of said plate and joined integrally to said panel, a pair of generally vertically extending slits formed through said plate, said slits being located on opposite sides of said connector and extending downwardly from the upper edge of said plate to points substantially short of the lower edge of said plate, said tab means comprising a pair of tabs located on opposite sides of said connector and capable of being flexed rearwardly from the plane of said plate by virtue of said slits.

3. A shelf divider as defined in claim 2 in which said foot is located adjacent the forward end of said panel and includes a forward edge, said connector including a generally horizontal portion integral with and extending forwardly from the forward edge of said foot and further including a generally vertical portion integral with said horizontal portion and the upper edge of said plate.

4. A shelf divider as defined in claim 3 in which said foot projects in one direction from said panel, and a second stabilizing foot integral with the lower edge of said panel adjacent the rear end thereof and projecting generally horizontally from said panel in a direction opposite from said one direction.

5. A shelf divider as defined in claim 1 in which said foot is located adjacent the forward end of said panel and projects in one direction from said panel, and a second stabilizing foot integral with the lower edge of said panel adjacent the rear end thereof and projecting generally horizontally from said panel in a direction opposite from said one direction.

6. A shelf divider made from a single piece of resiliently flexible plastic, said divider having an elongated dividing panel disposed in an upright plane, said panel having upper and lower edges and forward and rear ends, a stabilizing foot integral with and projecting generally horizontally from the lower edge of said panel adjacent the forward end thereof, said foot having a forward end, a connector integral with said foot and having a generally vertical portion extending downwardly from the forward end of said foot, a plate located forwardly of and below said panel and having an upper end joined integrally to the vertical portion of said connector, said plate having a lower end and being disposed in an upright plane located substantially perpendicular to the plane of said panel, a pair of generally vertically extending slits formed through said plate, said slits being located on opposite sides of said connector and extending downwardly from the upper end of said plate to points substantially short of the lower end of the plate, and tabs located alongside said slits and normally disposed in the plane of said plate, said tabs being capable of being flexed rearwardly from the plane of said plate by virtue of said slits.

7. A shelf divider as defined in claim 6 in which said foot projects in one direction from said panel, and a second stabilizing foot integral with the lower edge of said panel adjacent the rear end thereof and projecting generally horizontally from said panel in a direction opposite from said one direction.

* * * * *